US007661365B2

(12) United States Patent
Chan

(10) Patent No.: US 7,661,365 B2
(45) Date of Patent: Feb. 16, 2010

(54) CONNECTOR BLOCK CONFIGURED TO INDUCE A BEND IN SHOCK TUBES RETAINED THEREIN

(75) Inventor: Sek Kwan Chan, Pierrefonds (CA)

(73) Assignee: Orica Explosives Technology Pty. Ltd., Melbourne, Victoria (AU)

( * ) Notice: Subject to any disclaimer, the term of this patent is extended or adjusted under 35 U.S.C. 154(b) by 437 days.

(21) Appl. No.: 10/487,945

(22) PCT Filed: Sep. 6, 2002

(86) PCT No.: PCT/AU02/01232

§ 371 (c)(1),
(2), (4) Date: Oct. 8, 2004

(87) PCT Pub. No.: WO03/023315

PCT Pub. Date: Mar. 20, 2003

(65) Prior Publication Data

US 2005/0066834 A1 Mar. 31, 2005

(30) Foreign Application Priority Data

Sep. 7, 2001 (CA) ..... 2357082

(51) Int. Cl.
*C06C 5/06* (2006.01)

(52) U.S. Cl. ..... 102/275.12

(58) Field of Classification Search .. 102/275.1–275.12
See application file for complete search history.

(56) References Cited

U.S. PATENT DOCUMENTS

| | | | | |
|---|---|---|---|---|
| 4,722,279 | A | 2/1988 | Yunan | 102/275.4 |
| 5,171,935 | A | 12/1992 | Michna et al. | 102/275.7 |
| 5,204,492 | A | 4/1993 | Jacob et al. | 102/275.12 |
| 5,398,611 | A | 3/1995 | Michna et al. | 102/275.7 |
| 5,499,581 | A | 3/1996 | Sutula, Jr. | 102/275.12 |
| 5,659,149 | A | 8/1997 | Sutula, Jr. | 102/275.7 |
| 5,703,319 | A | 12/1997 | Fritz et al. | 102/275.7 |
| 6,123,025 | A | 9/2000 | Jacob et al. | 102/275.12 |
| 6,681,701 | B2 | 1/2004 | Perry | 102/275.7 |
| 7,188,566 | B2 * | 3/2007 | Gladden | 102/275.11 |
| 2003/0084812 | A1 | 5/2003 | Perry | 102/275.7 |

FOREIGN PATENT DOCUMENTS

| | | |
|---|---|---|
| AU | 11498/97 | 8/1997 |
| AU | 18221/97 | 8/1997 |

* cited by examiner

*Primary Examiner*—Michelle (Shelley) Clement
(74) *Attorney, Agent, or Firm*—Nixon & Vanderhye P.C.

(57) ABSTRACT

The present invention provides for a connector block for retaining at least one shock tube in signal transmission relationship with the percussion-actuation end of a detonator. The connector blocks of the present invention comprise a slot (7, 26, 46, 64, 87) for the retention of shock tubes therein, wherein the slot is configured to induce a bend (8*a*, 27*a*, 47*a*, 91*a*) in the shock tube(s). In this way, the position of the shock tube(s) relative to the detonator is significantly improved. Air gaps between the shock tubes and the detonator, resulting from manufacturing tolerances, can be substantially eliminated. Moreover, the connector blocks of the present invention provide an increased security of shock tube retention, thereby reducing the risk of accidental shock tube removal or displacement.

13 Claims, 5 Drawing Sheets

CONNECTOR BLOCK CONFIGURED TO INDUCE A BEND IN SHOCK TUBES RETAINED THEREIN

CROSS-REFERENCE TO RELATED APPLICATIONS

This application is the national phase of PCT international application Serial No. PCT/AU02/01232 filed Sep. 6, 2002, and claims the priority right of Canadian patent application 2,357,082 filed Sep. 7, 2001 by applicants herein.

FIELD OF THE INVENTION

The present invention relates to connector blocks for positioning shock tubes in signal transmission relationship with the percussion-actuation end of a detonator. In particular, the present invention relates to connector block designs that improve the efficiency of detonator to shock tube energy transmission.

BACKGROUND TO THE INVENTION

Blasting operations frequently trigger a series of explosions in an exact order, with precise timing. For this purpose, blasting systems have been developed that employ shock tubes (also known as signal transmission lines) that transfer a blast initiation signal to an explosive charge. A signal from a single shock tube can be transferred to multiple shock tubes in a blasting system via the use of connector block/detonator assemblies, thereby permitting the initiation of multiple explosive charges in a controlled manner.

Safety and reliability are paramount for any blasting system, and efficient shock tube initiation is an important factor in this regard. Shock tube initiation failure results in unexploded charges at the blast site, with inevitable safety concerns. Moreover, the reliable initiation of shock tubes ensures that the required blasting pattern is effected.

The efficiency of shock tube initiation depends primarily upon connector block design. Reliable initiation of shock tubes requires sufficient energy to be transferred from the base charge of the detonator to the shock tubes, thereby compressing the shock tubes extremely rapidly to initiate them.

The shock tube retention means of a connector block holds one or more shock tubes in contact with, or close proximity to, the percussion-actuation end of the detonator retained within the block. Importantly, the shock tube retention means ensures that the shock tubes are retained in signal transmission relationship with the detonator. Several examples of connector block designs are known in the art, which comprise a shock tube retention means for the arrangement of at least one shock tube adjacent to the percussion-actuation end of the detonator. These examples generally encompass the use of a clip-like member, integral with the connector block, for retaining the shock tubes within a slot formed between the clip-like member and the percussion-actuation end of the detonator. In this way, the shock tubes are retained in signal transmission relationship with the end of the detonator.

In one example, U.S. Pat. No. 5,204,492, issued to ICI Explosives USA Inc. on Apr. 20, 1993, discloses a detonator assembly for initiating up to eight transmission lines. The assembly comprises a connector block that houses a low strength detonator. The connector block comprises a confining wall surrounding the closed end of the low strength detonator. One or more signal transmission lines can be inserted through a gap in the confining wall and operatively confined adjacent to the percussion-actuation (closed) end of the low strength detonator.

Corresponding U.S. Pat. Nos. 5,171,935 and 5,398,611, issued to the Ensign Bickford Company on Dec. 15, 1992 and Mar. 21, 1995 respectively, disclose a connector block having a housing with a channel formed therein for receiving a low energy detonator. The connector block further comprises a tube engaging member for holding transmission tubes adjacent an end of the channel, wherein the tube engaging member is attached to the connector block via a resiliently deformable segment. Transmission tubes may be inserted into a slot formed between the housing and the tube engaging member.

In another example, U.S. Pat. No. 5,703,319, issued to the Ensign Bickford Company on Dec. 30, 1997, discloses a connector block comprising a clip member. The clip member cooperates with the signal transmission end of a body member to define a slot for receiving one or more signal transmission lines in communication with the output end of a detonator. The clip member is characterized in that it comprises a section of continuously decreasing thickness to facilitate lateral insertion of signal transmission lines into the slot by deformation of the clip member.

U.S. Pat. No. 5,499,581 issued to the Ensign-Bickford Company on Mar. 19, 1996, discloses a connector block design for connecting signal transmission lines in a blasting system. The patent discloses improved means for securing a detonator within the connector block via a displaceable locking member. The connector block may further comprise a flexible, cantilevered line retaining means to receive one or a plurality of outgoing signal transmission lines.

In a final example, U.S. Pat. No. 5,659,149 issued to the Ensign-Bickford Company on Aug. 19, 1997, discloses a connector block including a slot configured to constrain just a single acceptor line retained therein in an undulate configuration i.e. a configuration having consecutive (multiple) bends or kinks including zig-zags. In this way the acceptor line is retained more securely within the slot by virtue of the multiple contortions introduced into the acceptor line, thereby preventing unwanted sliding or displacement of the connector block along the acceptor line.

The connector blocks disclosed by the prior art generally retain at least one shock tube in signal transmission relationship with the percussion-actuation end of a detonator by confining the shock tube(s) within a slot. Preferably, the slot is dimensioned to retain the shock tubes in signal transmission relationship with the detonator, without unduly squeezing the shock tubes. In this way, the energy of detonator actuation compresses the shock tubes extremely rapidly, thereby resulting in their initiation.

The inventor of the present application has determined that optimal energy transfer requires contact between the shock tubes and the surface of the percussion-actuation end of the detonator (or the surface of a positioning surface, which is in contact with the detonator). However, the inventor has noted that dimensional tolerances in the manufacture of connector blocks and shock tubes can result in poor shock tube/detonator contact. For this reason, the insertion of an undersized shock tube into an oversized slot of a connector block can result in poor shock tube/detonator contact, and reduced transfer efficiency of actuation energy. Therefore, manufacturing tolerances can contribute significantly to shock tube initiation reliability. Furthermore, an undersized shock tube in an oversized slot would allow the block to slide uncontrollably to other undesirable locations along the shock tube.

In addition, plastic connector blocks comprising flexible shock tube retention means can exhibit variations in slot dimensions. The connector blocks of the prior art generally comprise flexible and resilient shock tube retention means in the form of a clip, for holding the shock tubes in signal transmission relationship with the percussion-actuation end of a detonator. The flexibility of the shock tube retention means can permit facile shock tube insertion. However, the inventor of the present application has determined that shock tube retention means of this kind may not properly reassume their original shape after distortion, thereby affecting the width of the shock tube retention slot. Moreover, the presence of one or more shock tubes within the slot can alter the configuration of the shock tube retention means, thereby affecting slot width for subsequent shock tube insertion. These factors may further increase the risk of improper shock tube/detonator contact within the connector block.

Accordingly, there is a need for improved connector block designs, wherein shock tubes are positioned in efficient signal transmission relationship with the percussion-actuation end of a detonator, and preferably in material contact with the detonator.

SUMMARY OF THE INVENTION

An object of the present invention, at least in a preferred form thereof, is to provide a connector block, wherein shock tubes are preferably retained in firm contact with the percussion-actuation end of a detonator. In this way, air gaps between the detonator and the shock tubes are essentially eliminated, thereby increasing the energy transfer efficiency from the detonator to the shock tubes.

It is a further object of the present invention, at least in a preferred form thereof, to provide a connector block wherein shock tubes are positioned accurately in signal transmission relationship with the percussion-actuation end of a detonator, wherein air gaps resulting from manufacturing tolerances are virtually eliminated.

It is a further object of the present invention, at least in a preferred form thereof, to provide a connector block, wherein the connector block is substantially prevented from sliding along the shock tubes located within the slot of the connector block.

Conventional connector block designs include a 'straight' slot for the retention of shock tubes. As will be apparent from the foregoing, a straight slot presents significant disadvantages with regard to the security of shock tube retention, and the possibility of the connector block being slidably displaced along the tubes. Moreover, previous attempts to address these issues have lead to the generation of connector blocks configured to constrain shock tubes in a contorted undulate configuration within the block, in which multiple bends or kinks are introduced into the shock tube(s) (see U.S. Pat. No. 5,659,149). However, the inventors have found that such contortions render the shock tubes difficult to insert into the connector blocks, and can present difficulties with maintaining optimal signal transmission.

The inventors unexpectedly found that the connector blocks of the present invention, in which a single principle bend is introduced into the shock tube(s) allows for optimization of multiple connector block attributes. The connector blocks disclosed herein permit relatively facile shock tube insertion, excellent detonator-to-shock tube signal transfer efficiency, secure retention of shock tubes, and uptake of unwanted tolerances in connector block or shock tube manufacture. Moreover, unlike the connector block designs disclosed in U.S. Pat. No. 5,659,149, the connector block of the present invention permit insertion of a plurality of shock tubes.

Therefore, in a first embodiment there is provided a connector block for retaining at least one shock tube in signal transfer relationship with a detonator, the connector block comprising: a housing having a bore formed therein for receiving a detonator provided with a percussion-actuation end; and a shock tube retention means defining with the housing a slot for receiving therein at least one shock tube and holding the shock tube(s) in signal transfer relationship with the percussion-actuation end of the detonator present in the bore, the slot having an entrance for allowing insertion of the shock tube(s) into the bore, characterized in that at least one of the housing and the shock tube retention means adjacent to the slot is configured to induce a bend in the shock tube(s) passing through the slot.

In an alternative embodiment, there is provided a connector block for retaining at least one shock tube in signal transfer relationship with a detonator, the connector block comprising: a housing having a bore formed therein for receiving a detonator provided with a percussion-actuation end; and a shock tube retention means defining with said housing a slot for receiving therein at least one shock tube and holding the shock tube(s) in signal transfer relationship with the percussion-actuation end of the detonator present in the bore, the slot having an entrance for allowing insertion of the shock tube(s) into the slot, characterized in that at least one of the housing and the shock tube retention means includes at least one projection facing the slot, which projection causes the shock tube(s) positioned in the slot to bend in a region passing through the slot.

The invention also relates to a detonator assembly comprising a connector block as defined above, a detonator positioned within the bore of the connector block housing and at least one shock tube retained within the slot of the connector block.

Preferably, the connector blocks of the present invention induce the shock tubes to contact the percussion-actuation end of the detonator. In an alternative embodiment, the connector blocks of the present invention further comprise a positioning membrane for positioning the surface of the percussion-actuation end of the detonator in signal transmission relationship with the slot. In this way, the slot may be defined in part by the positioning membrane. The corresponding connector blocks are preferably configured to ensure the shock tubes contact the positioning surface, which contacts the percussion-actuation end of the detonator. The positioning membrane may partially or completely enclose the signal transmission end of the bore.

In an alternative embodiment of the present invention, at least one of the housing or the shock tube retention means comprise two projections configured to induce a bend in the shock tube or shock tubes deposited within the slot of the connector block.

Preferably, the connector blocks of the present invention are suitable for housing a detonator with a hemispherical percussion-actuation end. In this way, the shock tubes may be arranged and retained within the slot equidistant from the initiation point of the hemispherical base charge within the percussion-actuation end of the detonator. In one embodiment, the shock tubes may be bent towards the percussion-actuation end of the detonator. In an alternative embodiment, the shock tubes may be bent away from the percussion-actuation end of the detonator.

The present invention encompasses connector blocks that induce one or more shock tubes positioned therein, to bend either towards or away from the detonator, whilst preferably contacting the percussion-actuation end of the detonator (or a positioning membrane in contact with the percussion-actuation end of the detonator).

The connector block configuration of the present invention induces a single principle bend (preferably a shallow arcuate curve) in one or several shock tubes as they pass within the slot, to improve the signal transmission and/or contact of the detonator with the shock tube(s). Advantageously, the present invention makes it possible to retain a plurality of shock tubes in signal transmission relationship with a detonator.

DEFINITIONS

"Bore"—either a hole (preferably, but not necessarily, cylindrical) running though the interior of the connector block of the present invention, or alternatively an open channel or groove formed in a side of the connector block, for the housing of a detonator therein.

"Bend"—a non-reversing smooth arcuate curve (as opposed to a sharp angled kink or right-angle bend) positioned within a slot of a connector block in a region of a percussion-actuation end of a detonator. The center or focus of the curve is generally located outside the region of the slot of the connector block (i.e. in the direction of the longitudinal axis of the bore, more distant than the nearest and furthest parts of the slot to the housing). Preferably, the bend is so shallow that the bend defines a curve having a centre or focus located a distance from the curve that is longer than half the length of the connector block. More preferably, the bend is even shallower, such that the bend defines a curve having a centre or focus located a distance from the curve that is longer than the connector block.

Figure 1:
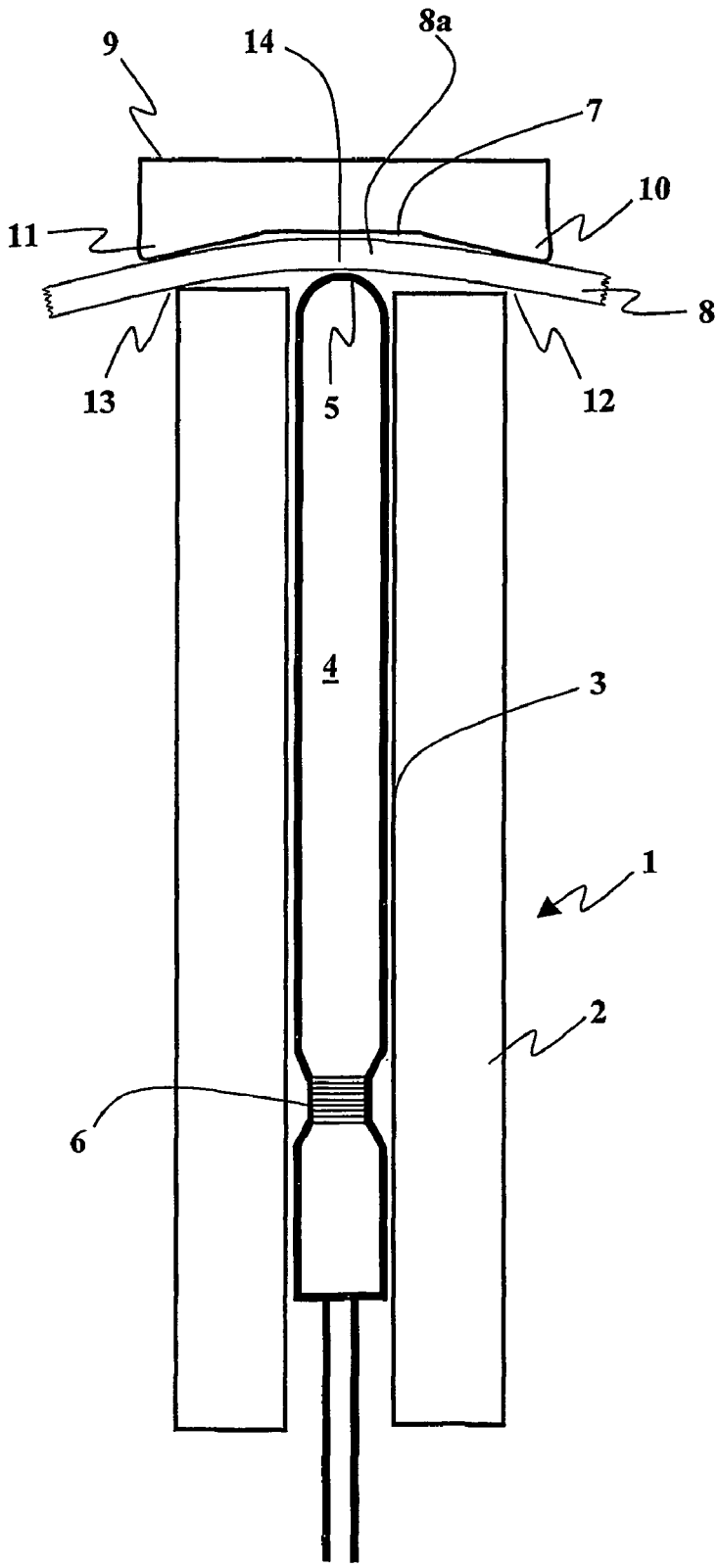
FIG. 1 is a longitudinal cross-section of a connector block according to a first preferred embodiment of the present invention.

"Bend towards the percussion-actuation end of the detonator"—a configuration of at least one shock tube, wherein the bend in the at least one shock tube is orientated in accordance with the embodiment illustrated in FIG. 1.

Figure 2:
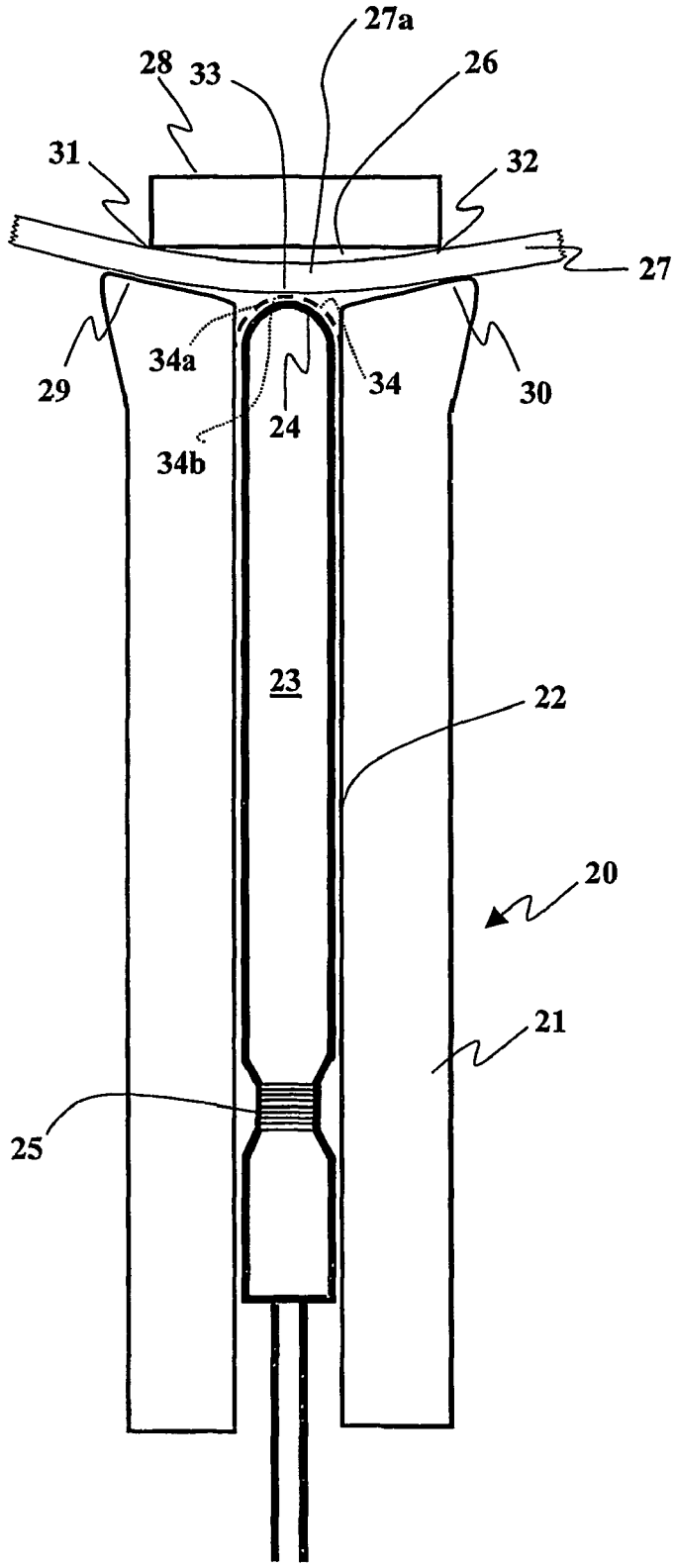
FIG. 2 is a longitudinal cross-section of a connector block according to a second preferred embodiment of the present invention.

"Bend away from the percussion-actuation end of the detonator"—a configuration of at least one shock tube, wherein the bend in the at least one shock tube is orientated in accordance with the embodiment illustrated in FIG. 2.

DETAILED DESCRIPTION OF THE PREFERRED EMBODIMENTS

The connector block of the present invention is configured to improve the positioning of shock tubes relative to the percussion-actuation end of a detonator (most preferably, air gaps between the shock tubes and the detonator, resulting from manufacturing tolerances, are substantially eliminated). For this purpose, the present invention provides significant improvements over existing connector block designs, by reducing the possibility of improper shock-tube/detonator contact within the connector block. The connector blocks of the present invention are preferably adapted to induce a single (or single principle) slight bend in the shock tubes inserted therein. In this way, the shock tubes are biased into signal transmission relationship with the detonator, and are forced to adopt a configuration that increases the possibility of optimal material contact and minimal separation distance between the shock tubes and the detonator percussion-actuation surface, despite variations in dimensions resulting from normal tolerances in the manufacture of the connector blocks, shock tubes and detonators.

Shock tubes are manufactured to exhibit a degree of resilience to bending forces, particularly over short distances of, for example, a few centimeters in length. For this reason, a region of a shock tube inserted within a connector block will tend to be straight (unless a bending force is applied). The connector blocks of the present invention utilize the bending resilience of shock tubes to improve the positioning of the shock tubes within the connector block. For this purpose, the connector blocks of the present invention comprise a slot, defined in part by a shock tube retention means on one side of the slot, and the detonator housing on the other side of the slot, wherein the slot is configured to induce a bend in one or more shock tubes deposited therein. In this way the shock tubes are forced to bend against a bias, and into an appropriate position adjacent the percussion-actuation end of a detonator.

It is believed that any degree of bending will improve shock tube positioning relative to the surface of the percussion-actuation end of a detonator. However, the preferred degree of shock tube bending will depend upon the expected degree of tolerance in the system. For example, if the shock tubes are known to have a diameter of 3 mm±10% (due to tolerance) then the slot should be configured to induce a sufficient bend in the shock tubes so that a shock tube of (e.g. of 2.7 mm diameter) is accurately positioned adjacent the end of the detonator. Any degree of bending is expected to improve both detonator to shock tube energy transmission, and shock tube retention within the connector block. Preferably, the degree of shock tube bending should not be so great as to substantially reduce the diameter of (or induce a kink into) the shock tube(s) since this may reduce initiation efficiency. Hence, in certain embodiments the present invention teaches away from U.S. Pat. No. 5,659,149 by generally avoiding connector block configurations that cause contortions or other undulations in the shock tubes retained therein.

The present invention encompasses any slot configuration that induces a bend in the shock tubes inserted therein. Particularly preferred embodiments of the present invention will be illustrated with reference to the accompanying drawings.

FIG. 1 illustrates a connector block 1 comprising a housing 2 with a bore 3 running longitudinally through the housing. The bore is configured for receiving a detonator 4, the detonator having a percussion-actuation end 5 and a closure crimp 6. The bore is configured to position the percussion-actuation end of the detonator in energy communicating relationship with a slot 7 for retaining at least one shock tube 8 therein (note that only one shock tube is visible in FIG. 1, but there would normally be several additional shock tubes present in the slot 7 in front of and behind the plane of the paper—see FIG. 4). The slot is defined in part by a shock tube retention means 9, and the adjacent housing 2. The shock tube retention means 9 may comprise a flexible, resilient material, or may comprise a rigid material. Preferably, the shock tube retention means 9 should be sufficiently rigid to bend the shock tubes without suffering undue deformation itself.

The slot 7 is dimensioned and configured to receive at least one shock tube in such a way that a bend 8*a* within the slot (as shown) is induced in part in each shock tube located therein.

The bend improves the contact between the shock tubes and the percussion-actuation end 5 of the detonator. In the embodiment shown in FIG. 1, the bend 8*a* in the shock tube is induced by two projections 10 and 11, integral with the shock tube retention means 9, and protruding into the slot 7 at each side thereof. In this way, the shock tube is forced to bend towards the detonator against the bias of its own stiffness, and exit the slot at positions 12 and 13. Importantly, a region 14 of the shock tube adjacent the percussion-actuation end 5 of the detonator is caused to contact the detonator, which protrudes slightly into the slot from the bore 3, thereby optimizing signal transmission in the event of detonator actuation. Although less preferred, similar shock tube/detonator contact can be attained with the provision of only one of projections 12 and 13 shown in FIG. 1.

A further embodiment of the present invention is illustrated in FIG. 2. The embodiment encompasses a connector block 20 comprising a housing 21 with a bore 22 running longitudinally through the housing. The bore is configured to receive a detonator 23 having a percussion-actuation end 24 and a closure crimp 25, and to position the percussion-actuation end 24 of the detonator in signal transfer relationship with a slot 26. The slot is dimensioned for retention of at least one shock tube 27 in energy communicating relationship with the percussion-actuation end of the detonator (note that the cross-section of the connector block is parallel with the longitudinal axis of the shock tubes located therein, and therefore only one shock tube is shown in FIG. 2). Furthermore, the slot is defined in part by a shock tube retention means 28, and the adjacent parts of the housing 21. The shock tube retention means may comprise a flexible; resilient material, or may comprise a more rigid material, as described for the embodiment shown in FIG. 1.

The slot 26 is dimensioned and configured to receive at least one shock tube 27, and induce a bend 27*a* in each shock tube located therein. The bend improves the contact between the shock tubes and the percussion-actuation end 24 of the detonator. In the embodiment shown in FIG. 2, the bend 27*a* in the shock tube is induced by two projections 29 and 30, integral with the housing 21, and protruding into the slot 26. In this way, the shock tube is forced to bend away from the detonator against a bias, and exit the slot at positions 31 and 32. Importantly, a region 33 of the shock tube adjacent the percussion actuation end of the detonator is forced into juxtaposition with the detonator, thereby optimizing signal transmission in the event of detonator actuation. In an alternative embodiment, a region of the shock tube may be induced to contact an outer surface 34*a* of a positioning membrane 34 (shown in broken lines in the Figure). The inner surface 34*b* of the membrane is in energy communicating relationship with the percussion-actuation end 24 of the detonator. The positioning membrane helps the user to insert the detonator into the bore 22 to the correct depth as the membrane acts as a stop. Although less preferred, similar shock tube/detonator contact can be attained with the provision of only one of projections 29 and 30 shown in FIG. 2.

The embodiments illustrated in FIGS. 1 and 2 provide for alternative shock tube configurations, wherein the shock tubes may bend towards the surface of the detonator (FIG. 1), or the shock tubes bend away from the surface of the detonator (FIG. 2). Either shock tube configuration is suitable for reducing the presence of gaps between the detonator and the shock tubes resulting from tolerances in the connector block and/or the shock tubes. However, without wishing to be bound by theory it is believed that the embodiment illustrated in FIG. 1 may provide improved shock tube/detonator contact over the embodiment shown in FIG. 2. In this regard, by bending the shock tubes towards (rather than away from) the detonator surface the length of shock tube/detonator contact is increased, and the average distance between the shock tube and the detonator surface in the slot is reduced. These factors are expected to provide improved efficiency of detonator to shock tube energy transmission upon detonator actuation.

Figure 3:
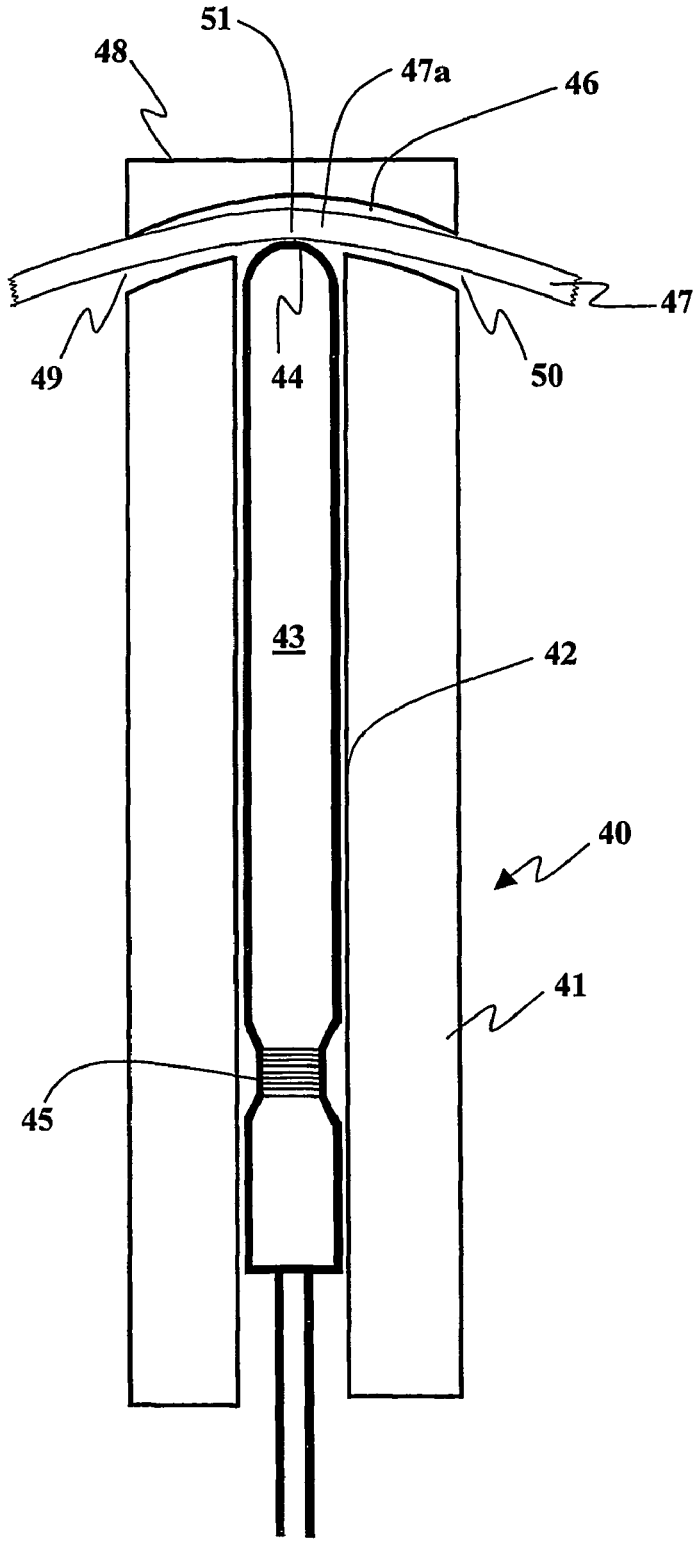
FIG. 3 is a longitudinal cross-section of a connector block according to a third preferred embodiment of the present invention.

A further embodiment of the present invention is illustrated in FIG. 3. In this regard, the slot has an arcuate shape in cross-section, relative to the longitudinal axis of the shock tube or shock tubes. The embodiment encompasses a connector block 40 comprising a housing 41 with a bore 42 running longitudinally through the housing. The bore is configured to receive a detonator 43 comprising a percussion-actuation end 44 and a closure crimp 45, and position the percussion-actuation end of the detonator in signal transfer relationship with a slot 46. The slot is dimensioned for retention of at least one shock tube 47 in energy communicating relationship with the percussion-actuation end of the detonator (note that the cross-section of the connector block is parallel with the longitudinal axis of the shock tubes located therein, and therefore only one shock tube is shown in FIG. 3). Furthermore, the slot is defined in part by a shock tube retention means 48, and the housing 41. The shock tube retention means may comprise a flexible, resilient material, or may comprise a more rigid material, as described for the embodiment illustrated in FIG. 1.

The slot 46 is dimensioned and configured to receive at least one shock tube, and induce a bend in each shock tube located therein. The bend improves the contact between the shock tubes and the percussion-actuation of the detonator. In the embodiment shown in FIG. 3, the bend in the shock tube(s) is induced by the shape of the slot in cross-section (relative to the longitudinal axis of the shock tubes located in the slot). In this way, the shock tube(s) are forced to bend towards the detonator against a bias, and exit the slot at positions 49 and 50. Importantly, a region of each shock tube 51 adjacent the percussion actuation end of the detonator is forced into juxtaposition with the detonator, thereby optimizing signal transmission in the event of detonator actuation. In an alternative embodiment, a region of the shock tube may be induced to contact a positioning surface, wherein the positioning surface is in energy communicating relationship with the percussion-actuation end of the detonator.

The present invention further encompasses a connector block similar to the connector block illustrated in FIG. 3, wherein the slot is of arcuate cross-section and induces the shock tube or shock tubes located therein to bend away from the detonator, whilst inducing contact with the percussion-actuation end of the detonator.

Figure 4:
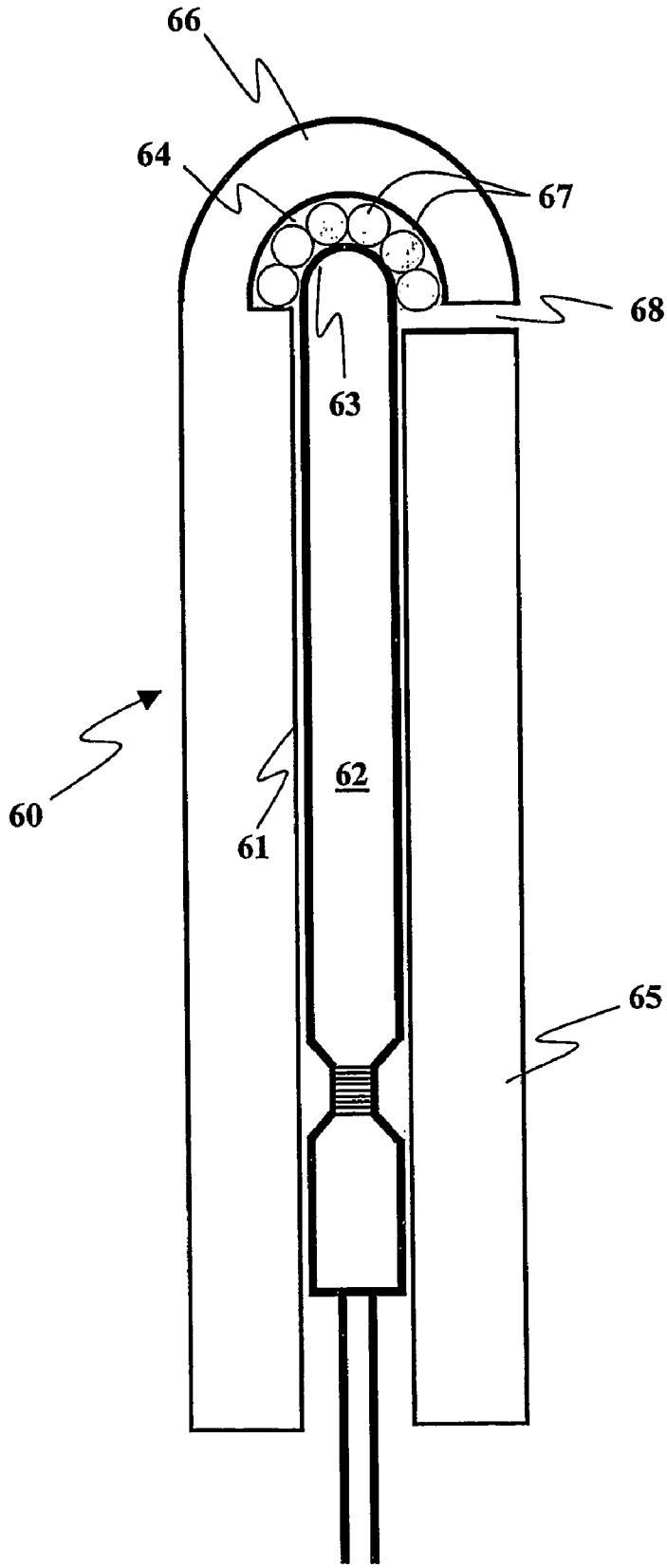
FIG. 4 is a longitudinal cross-section of a connector block according to the present invention, the longitudinal cross-section taken perpendicular to the cross-sections shown in FIG. 1, 2, or 3.

To clarify an arrangement of the shock tubes within the slot, a longitudinal cross-section of a preferred connector block of the present invention is illustrated in FIG. 4. In this regard, the longitudinal cross-section is taken perpendicularly to the cross-sections illustrated for the embodiments of the invention shown in FIGS. 1, 2, and 3. Moreover, FIG. 4 illustrates a preferred embodiment of the invention, wherein the percussion-actuation end of the detonator is hemispherical, and the shock tubes are arranged in the slot around the surface of the percussion-actuation end of the detonator, equidistant from the initiation point of the hemispherical base charge. The connector block 60 comprises a plastic housing 65 with a bore 61 running longitudinally through the housing for receiving a detonator 62 therein, with the percussion-actuation end of the detonator 63 in signal transmission relationship with a slot 64. The slot is defined in part by the housing 65 and a shock tube retention means 66, and is configured to retain at least one shock tube 67 in signal transmission relationship with the percussion-actuation end 63 of the detonator 62. The slot is configured to induce a bend in the shock tubes located therein (the bend in the shock tubes is not visible in FIG. 4, since the cross-sectional view illustrates the shock tubes perpendicular to their longitudinal axis). The slot comprises an entrance, which allows lateral insertion of one or more shock tubes into the slot. Preferably, the slot is dimensioned to permit insertion of up to six shock tubes.

Figure 5:
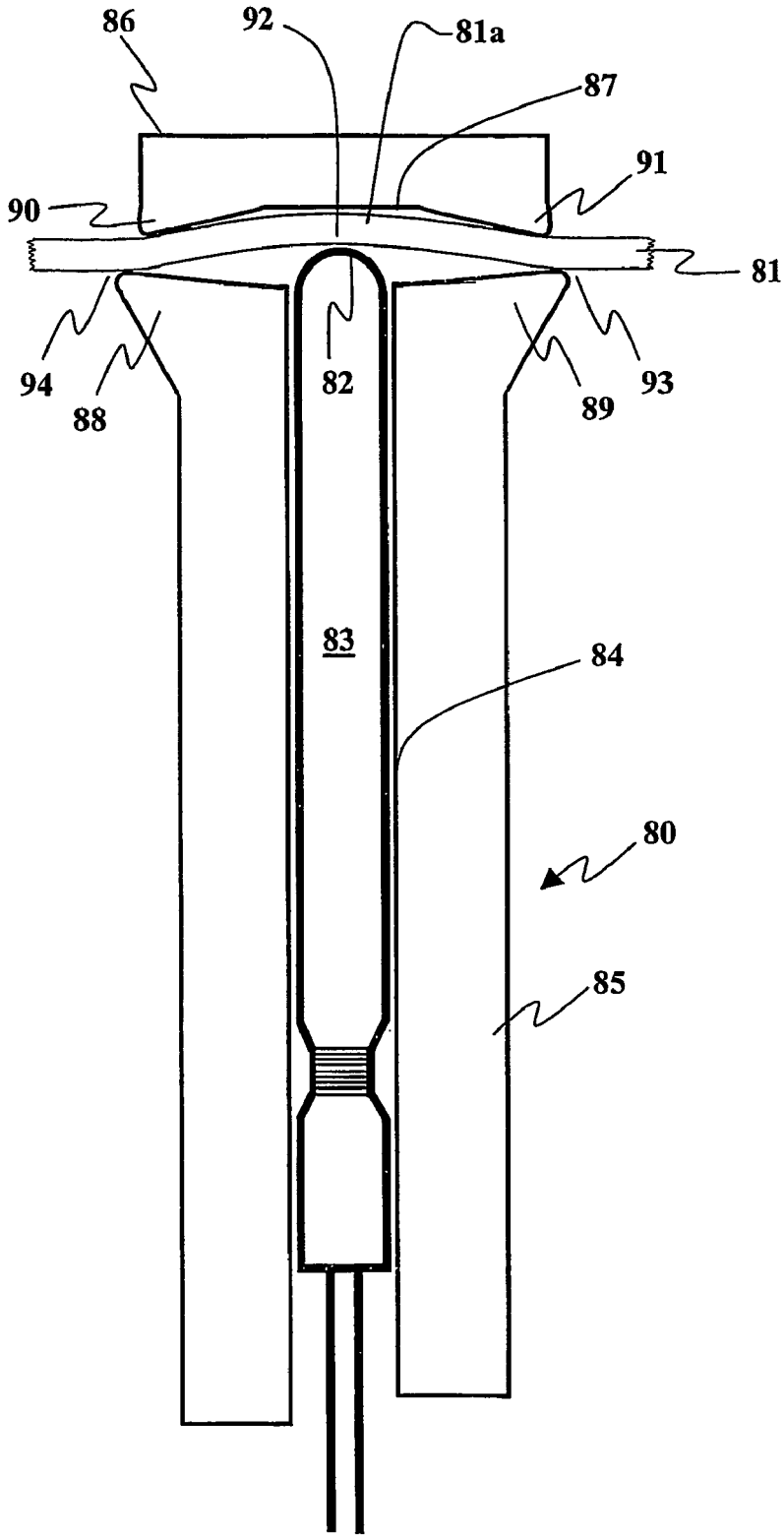
FIG. 5 is a longitudinal cross-section of a connector block according to a fourth preferred embodiment of the present invention.

A further preferred embodiment of the present invention is illustrated in FIG. 5. The embodiment provides for a connector block 80 that induces a bend in the shock tube(s) located therein, to retain the shock tube(s) in energy transmission relationship with the percussion-actuation end 82 of a detonator 83. The connector block comprises a housing 85 with a longitudinal bore 84 running though the housing for locating the detonator 83 therein. The connector block further comprises a shock tube retention means 86, which together with the housing 85 defines a slot 87.

In contrast to the embodiments illustrated in FIGS. 1 and 2, the connector block comprises projections 88 and 89 on the housing, and projections 90 and 91 on the shock tube retention means (90 and 91). In this way, projections 90 and 91 bend the shock tube(s) towards the detonator and push region 92 of the shock tubes onto the surface of the percussion-actuation end of the detonator.

The improvement in the preferred embodiment illustrated in FIG. 5 relates to the additional projections 88 and 89 present on the housing. The projections 88 and 89 alter the configuration of the shock tube(s) as they exit the slot at positions 93 and 94. The projections 88 and 89 induce the shock tubes to bend in a direction opposite to the bending influence of projections 90 and 91. In this way, the shock tubes are bent away from one another as they exit the slot, thereby reducing the potential for interference of crowding.

The potential for interference or crowding of shock tubes is best illustrated by simultaneous consideration of FIGS. 1 and 4, which may be considered alternative cross-sections though a similar connector block of the present invention, at 90° to one another each along the main longitudinal axis of the block. In this case, a detonator having a hemispherical percussion-actuation end is inserted into the connector block. Due to the alternative cross-section, FIG. 1 illustrates only one of the uppermost shock tubes shown in FIG. 4. However, although not visible in FIG. 4, each of the 6 shock tubes shown will also be retained in a bent configuration about the hemispherical percussion-actuation end of the detonator. For this reason, the plane of the bend for each shock tube will be offset relative to the plane of the bend of every other shock tube in the assembly. The alternative bending planes of each shock tube exiting the slot raises the potential problem for interference of the tubes. The embodiment of the invention illustrated in FIG. 5 therefore aims to overcome such interference problems.

Importantly, by avoiding shock tube interference, the shock tubes can be arranged in juxtaposition within the slot thus permitting insertion of a maximal number of shock tubes into the slot (for example as illustrated in FIG. 4). In FIG. 5, the shock tube illustrated is shown to exit the slot at positions 93 and 94 at an angle approximately perpendicular to the longitudinal axis of the detonator. This configuration is expected to substantially reduce the risk of interference between the shock tubes as they exit the slot. However, in alternative embodiments, the projections 88 and 89 may induce only a minor deviation in the bend of the shock tubes, or alternatively may bend the shock tubes away from the detonator as they exit the slot. These embodiments are also expected to reduce the risk of interference between the shock tubes as they exit the connector block. Although less preferred, similar shock tube/detonator contact can be attained with the provision of only one of projections 90 and 91, together with only one of projections 88 and 89 respectively.

It is also important to note that the projections 88 and 89 are generally configured to avoid shock tube crowding as multiple shock tubes exit the slot. The principle bend is introduced into each shock tubes as they pass within the slot by projections 90 and 91. The additional bends in the shock tubes induced by projections 88 and 89 occur generally on the periphery of, or generally outside of, the slot. The embodiment illustrated in FIG. 5 therefore provides for a connector block that introduces more than one bend into the shock tubes. However, only one principle bend is introduced into each shock tube generally within the confines of the slot, thereby taking up virtually all of the tolerance in connector block/shock tube manufacture, and biasing the shock tube towards the percussion-actuation end of the detonator.

Only one shock tube is illustrated in FIG. 5, due to the orientation of the cross section. However, more than one shock tube may be arranged around the detonator in accordance with the embodiment illustrated in FIG. 4.

The inventive concepts illustrated in FIG. 5 may also be applied to the shock tube configuration shown in FIG. 2. In this regard, the shock tube in FIG. 2 is configured to bend away from the end of the detonator by the influence of projections 29 and 30, which are integral with the housing. Additional projections may be provided on the shock tube retention means to alter the bending configuration of the shock tube(s) as they exit the slot at positions 31 and 32, thereby reducing the risk of interference between the shock tubes, as required.

Although the positioning membrane has been described in relation to an embodiment of the invention shown in FIG. 2, the use of a positioning membrane can be applied to any of the embodiments and corresponding slot configurations illustrated herein. The positioning membrane is preferably dimensioned and configured to position the detonator in efficient energy communicating relationship with the slot, and shock tubes subsequently inserted therein. The positioning membrane is preferably shaped for intimate contact with the surface of the percussion-actuation end of the detonator. For example, the positioning membrane may be hemispherical in shape to receive a hemispherical end of a detonator. In addition, the positioning membrane preferably comprises a material of suitable properties and thickness for efficient energy transmission from the base charge of the detonator to the shock tubes contained in the slot. The positioning membrane may partially or completely cover the end of the bore adjacent to the slot. In this way, the slot may be defined in part by the positioning membrane.

Without wishing to be bound by theory, it is believed that the connector blocks of the present invention provide improved security of shock tube retention. In this way, the configuration of the slot is predicted to increase the pull-out forces required to accidentally detach a shock tube from the connector block. Moreover, the improved shock tube retention is predicted to reduce the possibility of the connector block from sliding along the shock tubes located therein. Therefore, the connector blocks of the present invention may have the additional advantage of improved security of shock tube retention, with important benefits to the safety and reliability of the system.

While the invention has been described with reference to particular preferred embodiments thereof, it will be apparent to those skilled in the art upon a reading and understanding of the foregoing that numerous connector block designs that induce a bend in shock tubes located therein other than the specific embodiments illustrated are attainable, which nonetheless lie within the spirit and scope of the present invention. It is intended to include all such designs, and equivalents thereof within the scope of the appended claims.

Throughout this specification and the claims which follow, unless the context requires otherwise, the word "comprise", and variations such as "comprises" and "comprising", will be understood to imply the inclusion of a stated integer or step or group of integers or steps but not the exclusion of any other integer or step or group of integers or steps.

The reference to any prior art in this specification is not, and should not be taken as, an acknowledgment or any form of suggestion that that prior art forms part of the common general knowledge.

The invention claimed is:

1. A connector block for retaining at least one shock tube in signal transfer relationship with a detonator having a percussion-actuation end, the connector block comprising:

a housing with a bore extending longitudinally through the housing for receiving the detonator, and a shock tube retention means cooperating with an end of the housing proximal to the shock tube retention means to form, between the proximal end of the housing and the shock tube retention means, a slot extending transversely with respect to the longitudinally extending bore in the housing, the bore having an end proximal to the slot from which the percussion-actuation end of the detonator protrudes into the slot, when the detonator is positioned within the connector block, the shock tube retention means being wider than the housing at the end of the housing proximal to the shock tube retention means and including first and second protrusions that are proximal to first and second open ends, respectively, of the slot, the first and second protrusions causing the slot to be narrower at its first and second open ends than at a portion of the slot intermediate the first and second protrusions, the first and second protrusions overhanging the housing at the first and second open ends of the slot, wherein the first and second protrusions engage the at least one shock tube, when the at least one shock tube is extending through the slot and the first and second open ends of the slot, so as to cause the at least one shock tube to bend, without kinking, in a curvilinear and concave manner towards, and transverse to, the detonator, to thereby contact the percussion-actuation end of the detonator and be in signal transfer relationship with the detonator, when the detonator is positioned within the bore.

2. The connector block of claim 1, further comprising a positioning membrane for positioning the percussion-actuation end of said detonator in said housing, said at least one shock tube contacting said positioning membrane when in said slot.

3. The connector block of claim 1, wherein the opposing portions of the housing extend outwardly relative to the sides of the shock tube retention means so that the at least one shock tube retained in the slot is caused to bend away from a percussion-actuation end of a detonator retained in the bore.

4. A detonator assembly comprising a connector block of claim 1, a detonator positioned within the bore of the housing of the connector block, and at least one shock tube retained by and extending through the slot of the connector block.

5. The connector block of claim 1, wherein the first and second protrusions engage the at least one shock tube when it is extending through the slot so that a zenith of the curvilinearly bent at least one shock tube is located between the intermediate portion of the shock tube retention means and the proximal end of the housing.

6. The connector block of claim 5, wherein the at least one shock tube is bent towards the detonator so as to have a concave shape with respect to the detonator.

7. The connector block of claim 1, wherein the shock tube retention means is comprised of a flexible, resilient material.

8. The connector block of claim 1, wherein the shock tube retention means is comprised of a rigid material.

9. The connector block of claim 1, wherein the shock tube retention means is sufficiently rigid to bend the at least one shock tube without itself deforming.

10. The connector block of claim 1, wherein the shock tube retention means and the proximal end of the housing are parallel to one another at the intermediate portion of the shock tube retention means between the two protrusions into the slot.

11. The connector block of claim 1, wherein the shock tube retention means' two protrusions into the slot are each inclined towards the proximal end of the housing.

12. A connector block for retaining at least one shock tube in signal transfer relationship with a detonator having a percussion-actuation end, the connector block comprising:

a housing with a bore extending longitudinally through the housing for receiving the detonator; and a shock tube retention means cooperating with an end of the housing proximal to the shock tube retention means to form, between the proximal end of the housing and the shock tube retention means, a slot extending transversely with respect to the longitudinally extending bore in the housing, the bore having an end proximal to the slot from which the percussion-actuation end of the detonator protrudes into the slot, when the detonator is positioned within the bore, the shock tube retention means being wider than the housing at the end of the housing proximal to the shock tube retention means and including at least one protrusion into the slot that is proximal to a first or second open end of the slot, the at least one protrusion causing the slot to be narrower at the first or second open end corresponding to the protrusion than at a portion of the slot located other than where the at least one protrusion is located, the at least one protrusion overhanging the housing at the first or second open ends of the slot, wherein the at least one protrusion engages the at least one shock tube, when the at least one shock tube is extending through the slot and the first and second open ends of the slot, so as to cause the at least one shock tube to bend, without kinking, in a curvilinear and concave manner towards, and transverse to, the detonator, to thereby contact the percussion-actuation end of the detonator and be in signal transfer relationship with the detonator, when the detonator is positioned within the bore.

13. The connector block of claim 12, wherein the protrusion into the slot of the shock tube retention mean is inclined towards the proximal end of the housing.

* * * * *